US005265799A

United States Patent [19]

Stone

[11] Patent Number: 5,265,799

[45] Date of Patent: Nov. 30, 1993

[54] FLIP-TOP RECLOSEABLE CARTON AND LINER ASSEMBLY

[75] Inventor: James L. Stone, Grand Rapids, Mich.

[73] Assignee: Packaging Corporation of America, Evanston, Ill.

[21] Appl. No.: 990,342

[22] Filed: Dec. 14, 1992

[51] Int. Cl.[5] ..... B65D 5/56; B65D 5/54

[52] U.S. Cl. ..... 229/225; 220/418; 229/160.1; 493/96; 493/217; 493/907

[58] Field of Search ..... 229/224, 225, 226, 160.1; 206/268, 273; 220/416, 418, 441, 443, 461, 462, 463; 493/93, 95-97, 217, 906, 907

[56] References Cited

U.S. PATENT DOCUMENTS

| | | | |
|---|---|---|---|
| 2,367,476 | 1/1945 | Tyrseck | 220/416 |
| 2,396,310 | 3/1946 | Yungblut | 229/225 |
| 2,881,967 | 4/1959 | Ringler | 229/160.1 |
| 2,951,627 | 9/1960 | Wenzel | 220/416 |
| 3,432,090 | 3/1969 | Engel | 229/226 |
| 3,524,581 | 8/1970 | Buttery | 229/226 |
| 3,708,108 | 1/1973 | Rosenburg, Jr. | 229/225 |
| 4,048,052 | 9/1977 | Tolaas | 229/224 |
| 4,083,455 | 4/1978 | Keating, Jr. | 229/226 |
| 4,289,239 | 9/1981 | Meyers | 229/226 |
| 4,948,038 | 8/1990 | Moeller | 206/223 |
| 4,986,420 | 1/1991 | Gunn et al. | 229/225 |
| 5,092,516 | 3/1992 | Kastanek | 229/226 |
| 5,154,343 | 10/1992 | Stone | 229/225 |

FOREIGN PATENT DOCUMENTS

| | | | |
|---|---|---|---|
| 1017728 | 9/1977 | Canada | 229/225 |
| 2229996 | 10/1990 | United Kingdom | 220/416 |

*Primary Examiner*—Gary E. Elkins

*Attorney, Agent, or Firm*—Arnold, White & Durkee

[57] ABSTRACT

A flip-top recloseable carton and liner assembly includes a carton in the form of a six-sided parallelopiped enclosure having opposing top and bottom walls, front and back walls, and side walls formed from corresponding panels and flaps defined on a unitary, continuous paperboard blank. The assembly further includes a liner constructed and arranged to fit within the carton, the liner having opposing front and back panels and opposing side panels. The outer layers of the side walls and the front wall of the carton are provided with horizontal tear-strip sections which define an integral and continuous tear strip that functions as convenient means for opening the carton from its sealed form. Repeated closing and positive locking of the carton is realized using a die-cut portion on the liner front panel which includes a proximal flap and an island portion dispersed in forcibly displaceable mutual engagement. Once the engaging flap and island portion are disengaged forcibly by opening the carton top, reclosing thereof leads to snap re-engagement of the flap and island elements accompanied by positive tactile and audible feedback indicative of effective carton closure.

17 Claims, 6 Drawing Sheets

FLIP-TOP RECLOSEABLE CARTON AND LINER ASSEMBLY

FIELD OF THE INVENTION

The present invention relates generally to paperboard cartons and containers and the like. More specifically, the present invention relates to a carton and liner assembly having a flip-top recloseable lid.

BACKGROUND OF THE INVENTION

In a variety of consumer packaging applications, paperboard or cardboard containers must be capable of being safely stacked during storage and transit. Thus, a paperboard liner is often inserted into a slightly larger container to impart vertically oriented structural support to the larger container. Paperboard liners are typically cut from long rolls of paperboard into rectangular sections. Each such rectangular section, which is commonly referred to as a "blank," is formed into a four-sided tubular shape for insertion into a slightly larger container.

In many consumer packaging applications, it is also important to have paperboard containers which are capable of being conveniently, yet securely, opened and reclosed repeatedly. This is particularly important where the container or carton is used for storage of granular or powdered material, such as laundry detergent powder.

One exemplary recloseable carton and liner design uses a liner within the carton and a carton lid which hingedly attaches to the back panel of the base of the carton. In such packages or containers, an integral tear strip is generally used to permit the opening of the lid. The lid is separated from the base section of the carton by removing the tear strip and lifting the lid up. Subsequently, the carton is reclosed by pushing the lid back down to its original position.

Conventional recloseable carton and liner assemblies of the above-identified type suffer from disadvantages which severely restrict their use in certain consumer packaging applications, particularly where the packaged product constitutes granular or powdered material such as concentrated laundry detergent powder or the like. The present inventor has discovered that a major drawback in this regard is the general absence of a positive locking arrangement in combination with a carton design which is conducive to repeated open and reclose operations. More specifically, the previously discussed exemplary design has been found to be unacceptable in certain applications because of the likelihood of the lid opening by itself an leading to spillage of the contents thereof when such a closed carton is tipped over or otherwise disposed at an acute angle.

The present inventor has also discovered that such recloseable carton and liner assemblies can be improved by providing some form of positive indication, either tactile or audible, that an opened carton has been reclosed adequately in order to realize an effective locking position. It has been determined in this regard that the presence of such tactile or audible feedback indicative of effective locking is desirable because the presence thereof provides consumers with a high "comfort" factor with respect to reclosure. Particularly in applications where the recloseable cartons are used to contain liquids or to house granulated material having a restricted storage life once the storage container has been torn open, such positive feedback has been determined to provide an apparent sense of reassurance to consumers as to retention of "safety", "freshness", or scent of the contained product.

Accordingly, there exists a distinct need for a recloseable, flip-top carton and liner design which overcomes disadvantages of the above type associated with conventional recloseable paperboard carton and liner assemblies. The present invention effectively and conveniently realizes such a recloseable carton and liner assembly.

SUMMARY OF THE INVENTION

In accordance with the foregoing, the present invention provides a paperboard carton and liner assembly of the flip-top type which is repeatedly recloseable by means of a positive locking arrangement.

The present invention also provides a recloseable carton and liner assembly of the above type which includes a positive locking arrangement adapted to provide positive tactile and/or audible feedback indicative of effective closure. The assembly is realized using an efficient and cost-effective manufacturing process.

In a particular embodiment, the present invention provides a recloseable carton and liner assembly which is particularly adapted to contain granular or powdered material in the form of an enclosure which is easily assembled and conveniently opened and reclosed for effective dispensing of material contained therein.

According to a specific embodiment, the present invention provides a recloseable carton and liner assembly having a positive locking arrangement, with the assembly being adapted for effective containment of granular material and the locking arrangement providing positive feedback indicative of effective reclosure, as will be described in detail below in conjunction with the accompanying drawings. The recloseable carton of the liner-carton assembly is in the form of a six-sided parallelopiped enclosure having opposing top and bottom walls, front and back walls, and side walls formed from corresponding panels and flaps defined on a unitary, continuous paperboard blank. The side walls and the front wall are provided with horizontal tear-strip sections which define an integral and continuous tear strip that functions as convenient means for opening the carton and liner assembly from its sealed form. The liner of the present invention is constructed and arranged to provide structural support to the carton and includes opposing front and back panels and opposing side panels for fitting the liner snugly inside the carton.

Repeated closing and positive locking of the carton and liner assembly is realized by means of a cut-out portion on a liner wall which abuts against the interior surface of the front wall. The cut-out portion includes a proximal flap and an island portion dispersed in forcibly displaceable mutual engagement. Once the engaging flap and island portion are disengaged forcibly by opening the carton top, reclosing thereof leads to snap reengagement of the flap and island elements accompanied by positive tactile and audible feedback indicative of effective carton closure.

BRIEF DESCRIPTION OF THE DRAWINGS

Other objects and advantages of the invention will become apparent upon reading the following detailed description and upon reference to the drawings in which.

Figure 1:
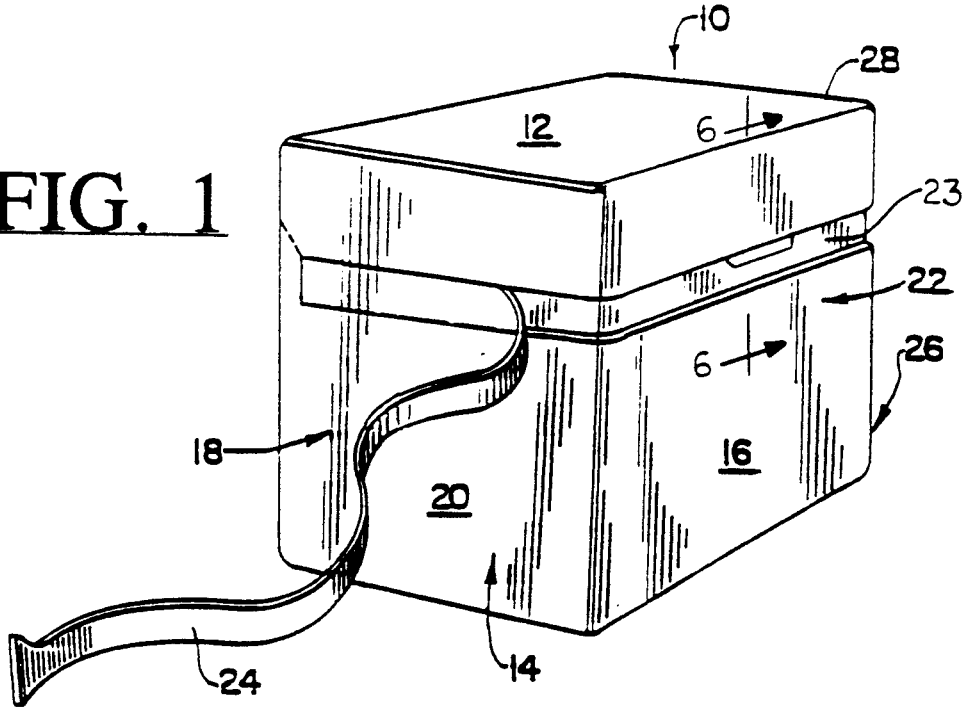
FIG. 1 is a perspective view of a recloseable paperboard liner-carton assembly in accordance with a preferred embodiment of the present invention, the liner-carton assembly being shown in its closed form with the tear strip partially pulled open.

While the invention is susceptible to various modifications and alternative forms, a specific embodiment thereof has been shown by way of example in the drawings and will herein be described in detail. It should b understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and in particular to FIG. 1, there is shown a perspective view of an exemplary flip-top, recloseable paperboard liner-carton assembly having a positive locking arrangement in accordance with an illustrative embodiment of the present invention. In particular, FIG. 1 shows a recloseable carton-liner assembly having a carton which is a six-sided parallelopiped enclosure formed of three pairs of opposing, generally rectangular walls or panels. More specifically, the carton 10 includes opposing top and bottom walls 12 and 14, opposing front and back walls 16 and 18, and opposing side walls 20 and 22. A liner 23 is contained within the carton 10 of the liner-carton assembly.

The side walls 20 and 22 and the relative upper portions of the front wall 16 are provided with horizontal tear strip sections which effectively form an integral and continuous tear strip 24. The tear strip 24 is fairly conventional and located about three panels of the blank used to form the recloseable carton 10, as will be described in detail below with reference to FIG. 2.

The tear strip 24 effectively permits a user to conveniently open the carton 10 once it has been filled with the requisite contents and sealed. Tearing or pulling away of the tear strip 24 as indicated in FIG. 1 effectively releases the sealed edges of the side walls 20, 22 and the front wall 16 in order to delineate the carton 10 into a bottom base portion generally indicated as 26 and an upper lid or top portion generally indicated as 28. The arrangement is such that, once the tear strip 24 has been completely pulled away, the carton lid 28 can be swung or raised upwardly away from the carton base 26 by virtue of a hinged attachment of the lid 28 to the base 26 along the back wall 18 of the carton 10. The liner 23 within the carton 10 is revealed where the tear strip 24 has been pulled away.

Figure 2:
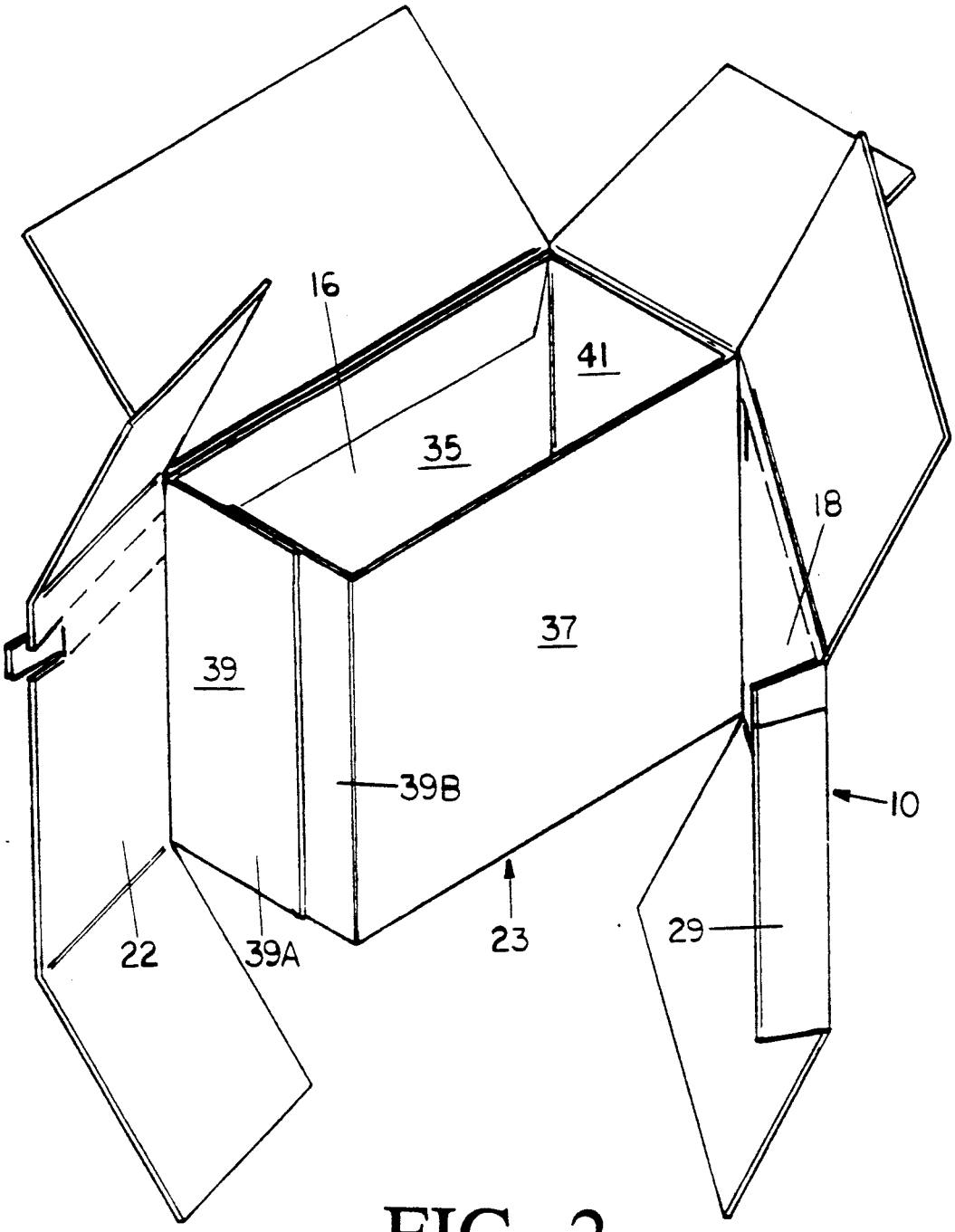
FIG. 2 is a perspective view of a liner-carton assembly, in accordance with the present invention, illustrating a formed paperboard liner partially within a carton.

FIG. 2 illustrates the liner 23 of FIG. 1 on the inside of a partially formed carton 10. The liner 23 is a four-sided tubular shape including two pairs of opposing, generally rectangular panels. More specifically, the liner 23 includes opposing front and back panels 35 and 37, respectively, and opposing side panels 39 and 41, respectively. The side panel 39 is formed by securing a rectangular flap 39A extending from the front panel 35 to a rectangular flap 39B extending from the back panel 37 by adhesive means such as glue.

Figure 3:
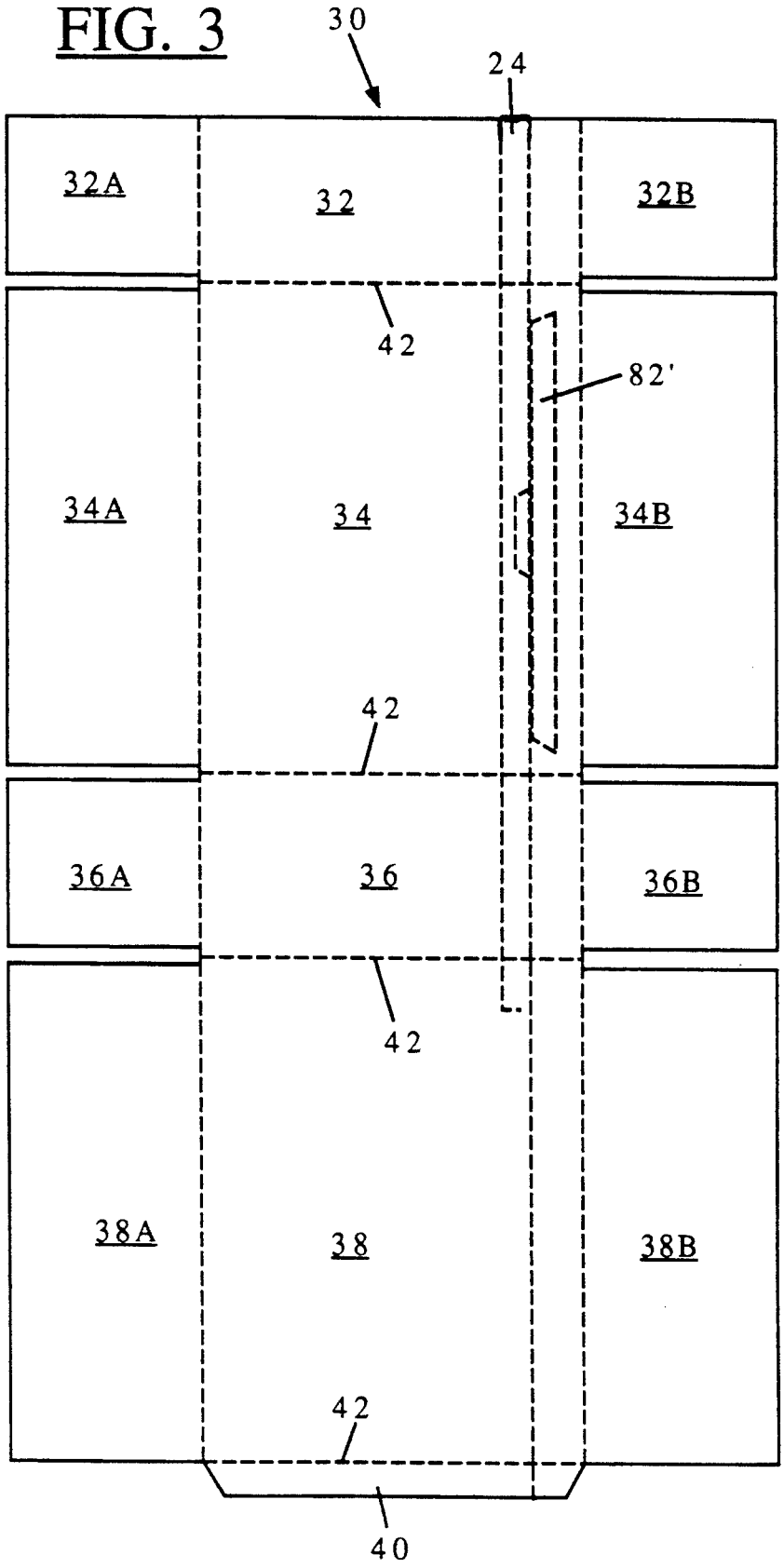
FIG. 3 is a plan view of the inside surface of a paperboard blank used to form the recloseable carton of the carton-liner assembly shown at FIG. 1, according to an illustrative embodiment of this invention.

The liner 23 and carton 10 are designed such that there is a snug fit between the liner 23 and the carton 10. The liner 23 may be adhered to the inside of the carton 10 by a conventional adhesive applied to one or more panels of the liner 23. In the preferred embodiment, the outside surface of the front and back panels 35 and 37 is partially adhered, by an adhesive such as glue, to the inside surface of corresponding front and back walls 16 and 18 of the carton 10. The carton 10 includes a flap 29 over which side wall 22 of the carton 10 is secured using the aforementioned adhesive FIG. 3 illustrates a plan view of the inside surface of a paperboard blank used for forming a recloseable flip-top carton of the liner-carton assembly described above in connection with FIGS. 1 and 2. As shown in FIG. 3, the blank 30 is in the form of a single, planar, unitary section of cardboard or paperboard which includes four vertically aligned, substantially rectangular panels 32, 34, 36, and 38 which are linked to each other by horizontal score lines 42 which facilitate folding of the carton panels relative to each other. With respect to the manner in which these panels interact to form the closed carton shown in FIG. 1, the panel 32 corresponds to the side wall 22, the panel 34 corresponds to the front wall 16, the : panel 36 corresponds to the side wall 20, and the panel 38 corresponds to the back wall 18.

Each of the four main panels comprising the carton blank 30 is provided with a pair of flaps connected along respective longitudinal edges by corresponding score lines. More specifically, the side wall panel 32 includes a left end flap 32A and a right end flap 32B. Similarly, left end and right end flaps 34A, 34B are respectively associated with the front wall panel 34, left and right end flaps 36A, 36B are respectively associated with the other side wall panel 36, and left and right end flaps 38A, 38B are associated with the back wall panel 38. In the illustrative embodiment of FIG. 3, the end flaps 32A-B and 36A-B have substantially the same transverse and longitudinal dimensions, and the end flaps 34A-B and 38A-B have substantially the same transverse and longitudinal dimensions.

The flaps associated with the four main panels interact in a conventional manner to form the top and bottom walls of a carton. With respect to the manner in which these flaps interact to form the closed carton shown in FIG. 1, the left end flaps 32A, 34A, 36A, and 38A function as the bottom wall 14, and the right end flaps 32B, 34B, 36B, and 38B function as the top wall 12.

The back wall panel 38 is provided with a flap 40 connected to back wall panel 38 by means of the horizontal score line 42. In connection with FIG. 2, the flap 40 corresponds to the flap 29 over which the side wall panel 32 (22 of FIG. 2) is secured by an adhesive such as glue.

In the embodiment of FIG. 3, the side wall panels 32, 36 and the front wall panel 34 have the longitudinal tea strip 24 extending integrally across the panels. The design and structure of the tear strip 24 and its operation in effective sealing and convenient tearing-open of a carton of the type disclosed herein is fairly conventional and, accordingly, not described in detail herein. It suffices to state that the tear strip 24 is substantially in the form of a pair of longitudinal parallel lines having a predefined depth of cut (at least about 30 percent) into the outer side of the side wall panels 32, 36 and the front wall panel 34 and includes a reinforcing tape (not shown) attached to the inner side of the tear strip 24 to prevent the strip from breaking apart as a result of the strip being removed from the carton 10 during the unsealing operation.

Figure 4:
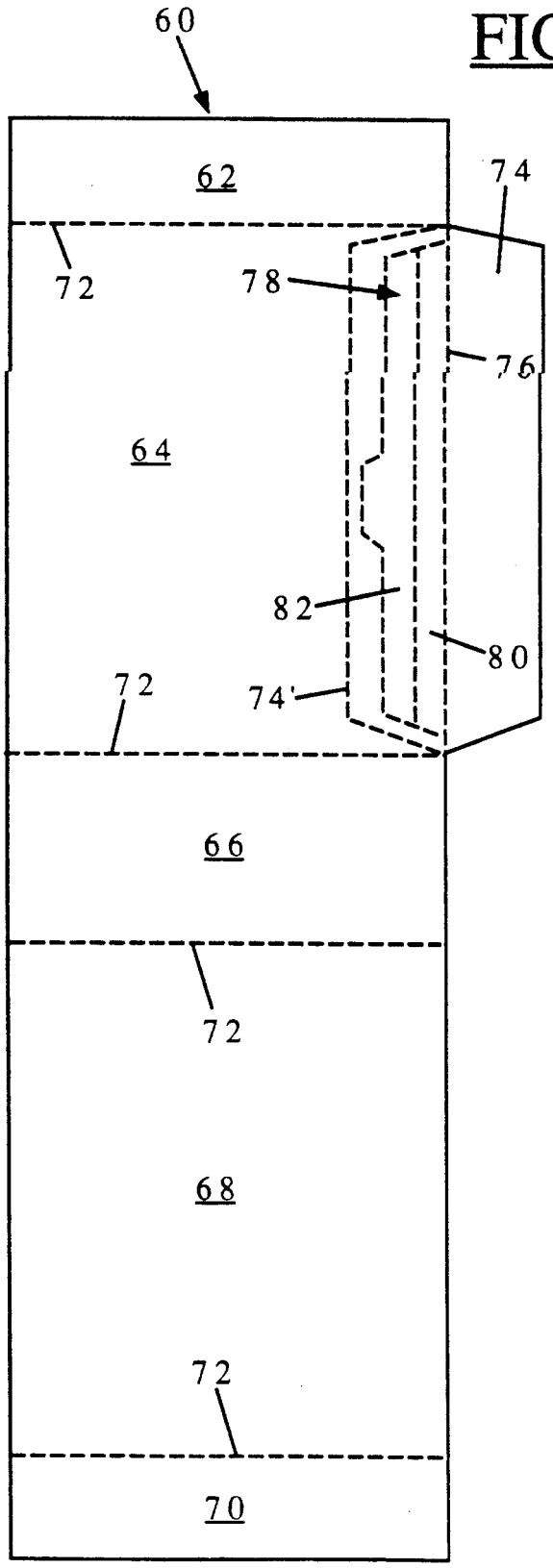
FIG. 4 is a plan view of the inside surface of a paperboard blank used to form the liner of the carton-liner assembly shown in FIG. 1, according to an illustrative embodiment of this invention.

Referring to FIG. 4, there is depicted a plan view of the inside surface of a paperboard liner used for forming the liner of the assembly described above in connection with FIGS. 1 and 2. As illustrated in FIG. 4, the liner blank 60 is in the form of a single, planar, unitary section of cardboard or paperboard which includes five vertically aligned, substantially rectangular panels 62, 64, 66, 68, and 70 which are linked to each other using horizontal score lines 72 which facilitate folding of the liner panels relative to each other. With respect to the manner in which these panels interact to form the liner shown in FIG. 2, the panel 64 corresponds to the front panel 35, the panel 66 corresponds to the side panel 41, and the panel 68 corresponds to the back panel 37. The panels 62 and 70 are partially adhered to one another by using adhesive, such as glue, to form the side panel 39 of FIG. 2.

The liner panels are sized so that the liner fits snugly within a carton formed from the carton blank 30 of FIG. 3. Thus, the transverse and longitudinal dimensions of the front panel 64 of the liner blank 60 are slightly smaller than the corresponding dimensions of the front wall panel 34 of the carton blank 30. The side panel 66 of the liner blank 60 has slightly smaller transverse and longitudinal dimensions than the corresponding dimensions of the side wall panel 36 of the carton blank 30. Similarly, the back panel 68 has slightly smaller dimensions than the corresponding dimensions of the back wall panel 38. Finally, the side panel formed from the panels 62 and 70 of the liner blank 60 has slightly smaller dimensions than the corresponding dimensions of the side wall panel 32 of the carton blank 30.

For additional information concerning the liner design and the general arrangement of the liner within the carton, reference may be made to co-pending patent application Ser. No. 07/958,013 entitled Paperboard Container Liner and co-pending patent application Ser. No. 07/957,681 entitled Improved Carton and Liner Tear-Tape Assembly, both filed on Oct. 7, 1992, and incorporated herein by reference. As an alternative embodiment, the liner design of the co-pending patent application Ser. No. 07/958,013 is modified to incorporate the removed sections of the liner to realize a paperboard savings.

In accordance with the liner-carton assembly of the present invention, the front panel 64 of the liner blank 60 is provided with an overhanging flap 74 which is connected to the right longitudinal edge of the panel 64 using a line of weakness 76 which is akin to the earlier-described lines of weakness used for linking the four main panels together. It should be noted that the line of weakness 76 linking the flap 74 to the front panel 64 is creased sufficiently deep so as to permit bending or hingedly rotating the flap 74 upwardly and inwardly in order to be adhered, by an appropriate glue or like adhering means, to the inside surface of the panel 64, i.e., the surface of the panel 64 which is shown in FIG. 4. The position of the flap 74 after it has been attached to the inside surface of the panel 64 is denoted by the reference numeral 74'.

Also, in accordance with the present invention, the front panel 64 has a die-cut portion 78 thereupon which includes a proximal flap 80 about the right transverse edge of the front panel 64 by the same line of weakness 76 which links the overhanging flap 74 to the front panel 64. In addition, the die-cut portion 78 includes a flap-receiving or distal island portion 82 which is linked to the leading transverse edge of the flap 80 and the surrounding sections of the panel 64 by means of weakening "nicks", whereby the distal island portion 82 may easily be separated from both the surrounding portion of the front panel 64 and the proximal flap 80.

The positive closure arrangement is best described by reference to both FIGS. 3 and 4, which illustrate the carton blank 30 and the liner blank 60, respectively. In particular, the die-cut portion 78 of FIG. 4, including the proximal flap 80 and the distal island portion 82, is designed to be such that the island portion 82 may be adhered in a fixed manner to the inside surface of the front panel 34 of FIG. 3 to the right of the tear-strip 24 generally in a position indicated in dashed lines by the numeral 82'. The arrangement is such that when the recloseable liner-carton assembly of FIG. 1 is formed using the carton and liner blanks of FIGS. 3 and 4 and the carton 10 is initially opened by tearing away the tear-strip 24 and upwardly raising the lid 28 thereof, the island portion 82 on the cut-out portion 78 of the liner blank 60 breaks free of its restricting nicks and remains attached to the lid 28 about the inner surface of the front panel 34 of the carton blank 30 at position 82'.

A key advantage with respect to the above-described flap arrangement using the die-cut portion 78 is that when the carton formed from the blank 30 is opened by raising the lid 28, the proximal flap 80 is also rotated outwardly and upwardly. Subsequently, when the carton is closed by replacing the lid to its initial closed position, the island portion 82 depresses the proximal flap 80 in a downward direction. More importantly, when the lid is closed down to such an extent that the island portion 82 moves down beyond the extension of the proximal flap 80, the island portion 82 snaps into a locked position and is restrained from upward movement by the confining action of the proximal flap 80 exerted upon the opposing transverse edge of the island portion 82.

As a result, the reclosed lid can only be opened by the exertion of a direct force sufficient to snap the island portion 82 back out of engagement with the proximal flap 80 by virtue of the upward and outward rotation thereof due to the opening of the lid. It will, of course, be recognized that the above-described "snap" action undergone by the island portion 82 relative to the proximal flap 80 as the lid 28 of the carton 10 is reclosed provides positive tactile as well as audible feedback indicative of effective reclosing and, more importantly, locking of the lid 28 relative to the base section 26 of the carton 10.

It should be noted that the manner in which the liner-carton assembly shown in FIG. 1 is assembled from the carton blank 30 and liner blank 60 is fairly conventional except for the above-described manner according to which the overhanging flap 74 and the die-cut portion 78 (which may be viewed as including the proximal flap 80 and the island portion 82) is folded and fixedly adhered to the aforementioned portions of the carton and liner blank panels. The overall operations involved in assembling the carton blank 30 and the liner blank 60 into the liner-carton assembly are well-known to those skilled in the art of paperboard packaging containers and is, accordingly, not described in detail herein.

It is sufficient to state herein that the outside surface of the liner blank 60 of FIG. 4 (i.e., the surface hidden from view) is first positioned against the inside surface of the carton blank 30 of FIG. 3 with the liner front panel 64 substantially overlapping the carton front wall panel 34, the liner side panel 66 substantially overlapping the carton side wall panel 36, and the liner back panel 68 substantially overlapping the carton back wall panel 38.

The outside surface of the liner front panel 64 is adhered to the inside surface of the carton front wall panel 34 with glue applied on the carton front wall panel 34 at the position 82' and at other positions to the left of the tear strip 24. By applying glue or other adhesive means at the position 82', the outer surface of the island portion 82 which contacts the inner surface of the front wall panel 34 is glued or otherwise fixedly adhered thereto. It is significant that the proximal flap 80 is not affixed to the corresponding inner surface of the front wall panel 34 but, instead, remains in contact therewith by virtue of being linked to the island portion 82 through the connection using the weak nicks described above.

Second, the overhanging flap 74 is folded to the extent of 180° about the line of weakness 76 and glued or otherwise adhered so that it lies permanently against the inner surface of the front panel 64. The glue is applied to the right longitudinal edge of the overhanging flap 74.

Third, the liner blank 60 in FIG. 4 is folded and glued to form a generally rectangular, four-sided tubular body by appropriately folding the five main panels 62, 64, 66, 68, and 70 about corresponding score lines 72. At this point, the liner-carton assembly appears as illustrated in FIG. 2.

Finally, the carton blank 30 in FIG. 3 is folded and glued in a conventional fashion to form the closed liner-carton assembly shown in FIG. 1. Closing the carton about the liner to form the closed liner-carton assembly of FIG. 1 is preferably performed in two stages: first, closing and sealing one end (top or bottom) of the box, and next filling the box with the requisite contents prior to closing the remaining end of the box to yield a closed and entirely sealed carton-liner assembly.

Figure 5:
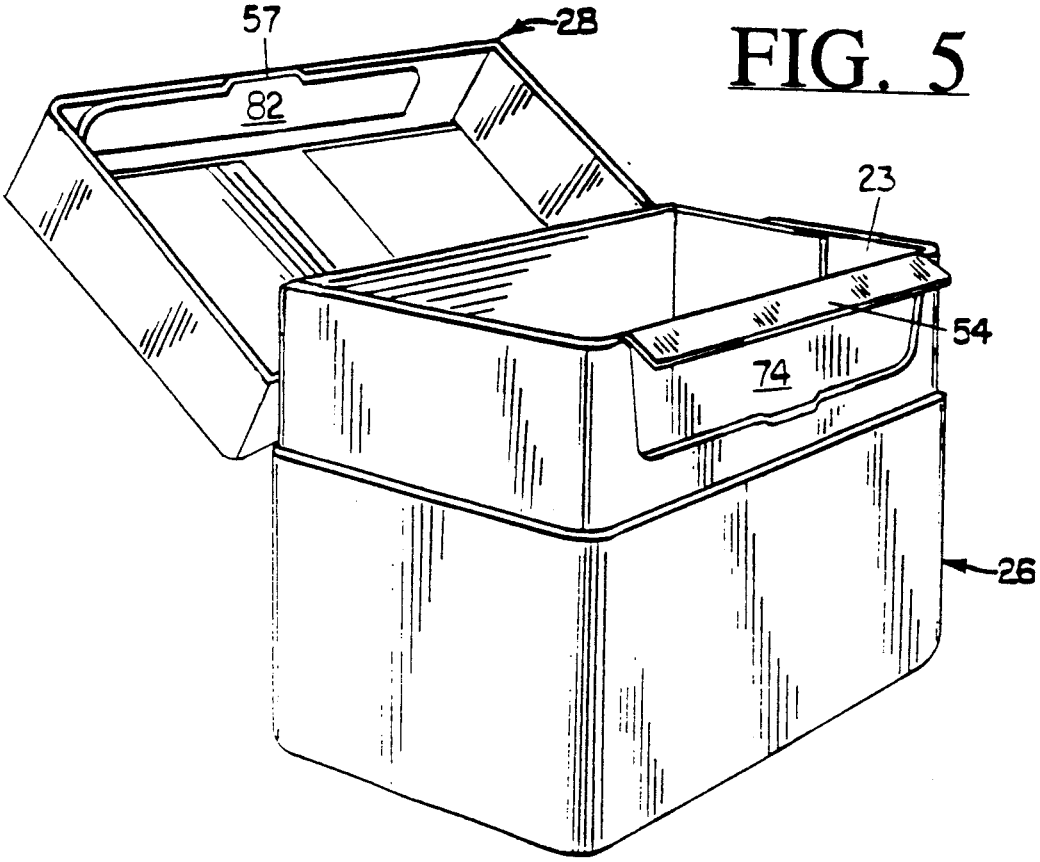
FIG. 5 is a perspective view of the recloseable carton-liner assembly of FIG. 1, as shown in its open condition with the lid raised upwardly to open the carton.
Figure 6:
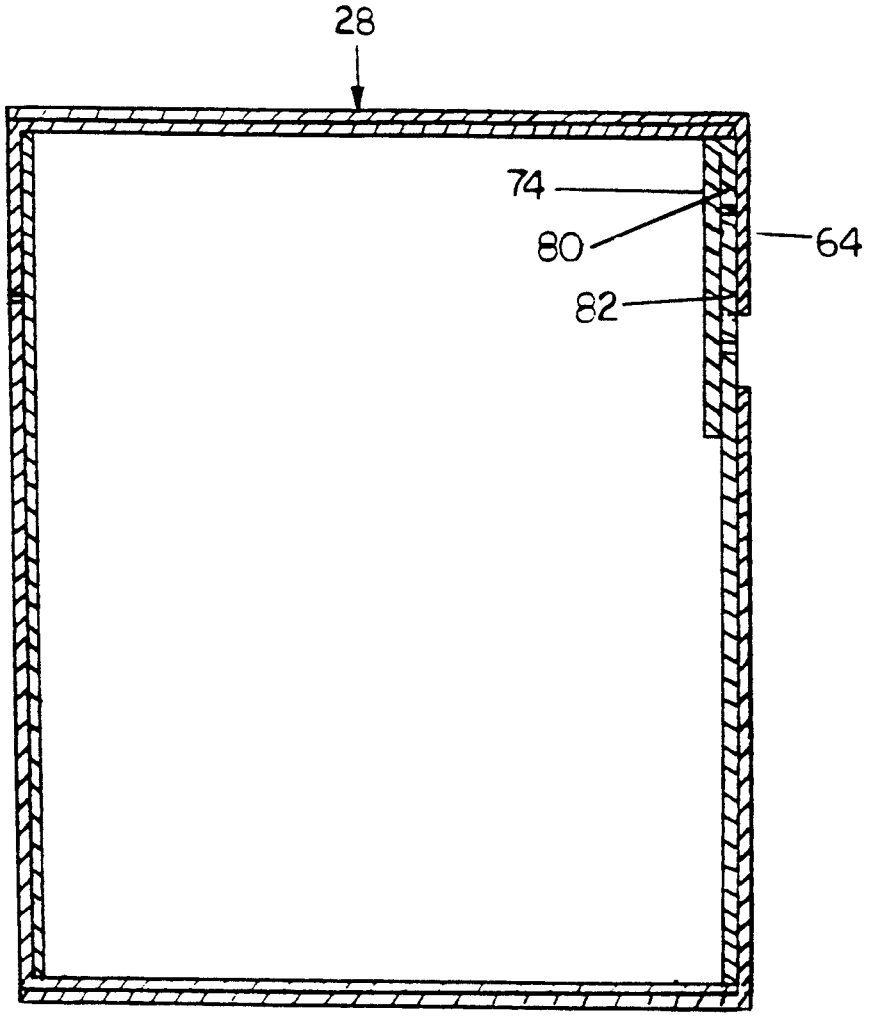
FIG. 6 is a segmented cross-sectional view taken along line 6—6 in FIG. 1 and illustrating the positive locking arrangement of the liner-carton assembly of the present invention.
Figure 7:
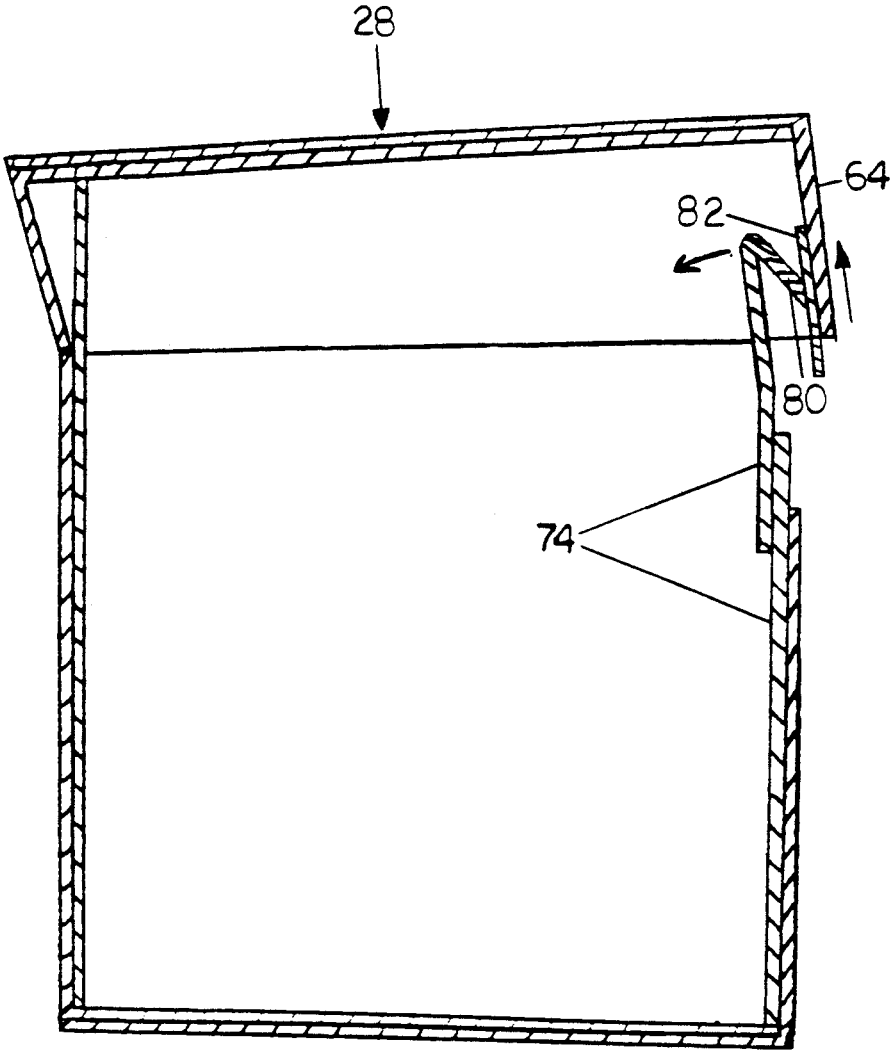
FIG. 7 is a similar segmented cross-sectional view of the positive locking arrangement showing the carton in a partially open condition.

Referring now in particular to FIGS. 5, 6, and 7, there are shown illustrations which facilitate an understanding of the manner in which the positive recloseable locking arrangement functions in accordance with the liner-carton assembly of the present invention. As particularly shown in the segmented cross-sectional view of FIG. 6, when the carton is in its sealed condition, the island portion 82 remains attached to the proximal flap 80 by virtue of the weak nicks through which the two elements are linked. In addition, the island portion 82 is permanently adhered to the corresponding inner surface of the front wall panel 34. At the same time, both the island portion 82 and the proximal flap 80 also remain in contact with the folded over overhanging flap 74 of the front liner panel 64.

When the tear strip 24 has been torn away and the box is opened by pushing the lid 28 in an upwardly direction (as indicated by the large arrow in the segmented cross-sectional of FIG. 7) the upper transverse edge of the island portion 82 pushes against the corresponding opposing transverse edge of the proximal flap 80. When the upward force exerted upon the lid 28 sufficiently forces the proximal flap 80 as well as a portion of the overhanging flap 74 to "give" in the general direction of the small arrow (see FIG. 7) the island portion 82 clears the restriction presented thereto by the proximal flap 80 and the lid 28 becomes free to be opened. It should be noted that the upward movement of the lid 28 and island portion 82 initially causes the proximal flap 80 to be hingedly rotated in a upward direction until the upward movement, in combination with the "give" of the proximal flap 80 and overhanging flap 74, allows the island portion 82 to clear the proximal flap 80. As shown in FIG. 5, the island portion 82 includes a tab 57 which can be grasped by a user for assistance in opening the lid 28.

When the recloseable carton 10 is reclosed by closing the lid back to its original position, a similar interaction between the proximal flap 80 and the island portion 82 takes place. More specifically, downward movement of the lid 28 causes the island portion 82 attached thereto to move against proximal flap 80. As the downward force is continued to be exerted, the island portion 82 causes the proximal flap 80 to be hingedly rotated in a downward direction while, at the same time, causing the proximal flap 80 and the overhanging flap 74 to again "give" until the island portion 82 completely bypasses the proximal flap 80 and snaps into a locked position with contact between opposing transverse edges of the island portion 82 and the proximal flap 80. It is this snap/locking action which produces the above-described positive tactile and audible feedback when the lid 28 has been effectively locked.

A significant advantage of using the above-described structural design for the positive closure arrangement is that the interlocking elements, i.e., the proximal flap 80 and the distal island portion 82, are both defined on the front panel of the liner blank. In particular, this design prevents any possibility of the elements being separated from each other or, more importantly, from the liner blank, as a result of any step involved in the assembly process.

The design is also advantageous in that it avoids unnecessary board build-up resulting from folding over of liner and carton panel sections in order to define the interlocking elements. More specifically, the interlocking action of these elements, as described above with respect to FIGS. 5–7, is realized with minimal board build-up.

While the present invention has been described with reference to one or more particular embodiment, those skilled in the art will recognize that many changes may be made thereto without departing from the spirit and scope of the present invention. Moreover, skilled artisans will recognize that various embodiments have been disclosed herein. For example, in one embodiment the design of the liner front panel is modified to include a cut-away portion at the bottom edge of the panel in the shape of the overhanging flap 74. The cut-away portion would allow for nesting of liner-carton assemblies in early stages of production.

In another embodiment, the design of the liner is modified such that the back wall of the liner is incomplete. More specifically, a "3⅛" panel liner can be used which has a front panel, two opposing side panels, and a partial back panel comprised of two non-overlapping flaps extending from each of the side panels.

Each of these embodiments and obvious variations thereof is contemplated as falling within the spirit and scope of the claimed invention, which is set forth in the following claims.

What is claimed is:

1. A recloseable liner-container assembly, comprising:

a container including opposing top and bottom walls, opposing front and back walls, and opposing side walls, the side walls and front wall including a contiguous horizontal tear strip for opening up the container from a sealed form to form a lid hingedly attached to a base section;

a liner constructed and arranged for placement within the container and including a front panel and opposing side panels for fitting the liner within the container, the front panel having an outer surface adjacent to an inner surface of the container front wall; and wherein the liner front panel includes a flap and a flap-receiving portion disposed in forcibly displaceable mutual engagement such that opening the container lid exerts a force which disengages the mutual engagement between the flap and the flap-receiving portion, and reclosing the lid leads to snap re-engagement of the flap and the flap-receiving portion.

2. The recloseable liner-container assembly as recited in claim 1, wherein the snap re-engagement of the flap and the flap-receiving portion is accompanied by positive tactile and audible feedback.

3. The reclosable liner-container assembly as recited in claim 2, wherein the liner and the container are assembled such that the flap-receiving portion is fixedly attached to an inner surface of the container lid and at the same time separately attached to the flap, and wherein opening of the lid separates the flap-receiving portion from the flap while retaining the flap on the liner front panel.

4. The reclosable liner-container assembly as recited in claim 3 wherein the flap-receiving portion includes an island portion.

5. The reclosable liner-container assembly as recited in claim 3 wherein the flap and the flap-receiving portion are separately linked to each other about opposing transverse edges thereof, a distal transverse edge of the flap-receiving portion being separately attached to the liner front panel, wherein opening of the container lid causes the flap-receiving portion to be separated from the flap and the liner front panel and be retained on the inner surface of the container lid.

6. The reclosable liner-container assembly as recited in claim 5 wherein opening of the container lid causes the opposing transverse edge of the flap-receiving portion to push against the opposing transverse edge of the flap until the engagement therebetween is released by relative inward movement of the flap and the liner front panel to which it is attached.

7. The reclosable liner-container assembly as recited in claim 6 wherein the flap-receiving portion includes a tab adapted to be grasped by a user in opening the container lid.

8. The reclosable liner-container assembly as recited in claim 5 wherein reclosing of the container lid causes re-engagement between the opposed transverse edges of the flap-receiving portion and the flap by interaction between the flap and the flap-receiving portion wherein the flap and the liner front panel undergo relative inward movement until the flap-receiving portion realizes snap engagement between the opposed transverse edges accompanied by the positive tactile and audible feedback.

9. The reclosable liner-container assembly as recited in claim 3, wherein the liner further includes an overhanging section connected to an inner surface of the liner front panel, the overhanging section being adjacent to the flap and the flap-receiving portion.

10. A reclosable liner-container assembly, comprising:

a container including opposing top and bottom walls, opposing front and back walls, and opposing side walls, the side walls and front wall including a contiguous horizontal tear strip for opening up the container from a sealed form to form a lid hingedly attached to a base section;

a liner constructed and arranged within the container and including a front panel and opposing side panels for fitting the liner within the container, the front panel having an outer surface adjacent to an inner surface of the container front wall;

wherein the liner front panel includes a die-cut portion, disposed in proximity to the tear strip, having (i) a flap arranged substantially parallel to the tear strip, the flap having a first transverse edge hingedly connected to the liner front panel and (ii) an island portion separatably linked to a second transverse edge of the flap and surrounding sections of the liner front panel by means of weakening nicks, an outer surface of the island portion being fixedly attached to an inner surface of the container lid; and wherein the flap and the island portion are disposed in forcibly displaceable mutual engagement such that removing the tear strip and opening the container lid causes the island portion to break free of the weakening nicks and to disengage the mutual engagement, and reclosing the lid leads to snap re-engagement of the flap and the island portion.

11. A reclosable liner-container assembly, comprising:

a container including opposing top and bottom walls, opposing front and back walls, and opposing side walls, the side walls and front wall including a contiguous horizontal tear strip for opening up the container from a sealed form to form a lid hingedly attached to a base section;

a liner constructed and arranged for placement within the container and including a front panel and opposing side panels for fitting the liner within the container, the front panel having an outer surface adjacent to an inner surface of the container front wall, the front panel and the side panels having a smaller longitudinal dimension than the respective front wall and side walls of the container such that the front panel and side panels line an upper portion of the front wall and the side walls; and wherein the liner front panel includes a flap and a flap-receiving portion disposed in forcibly displaceable mutual engagement such that opening the container lid exerts a force which disengages the mutual engagement between the flap and the flap-receiving portion, and reclosing the lid leads to snap re-engagement of the flap and the flap-receiving portion.

12. The reclosable liner-container assembly as recited in claim 11, wherein the front panel and the side panels line approximately an upper one-fourth to one-half of the front wall and the side walls of the container.

13. A method of producing a reclosable liner-container assembly, comprising the steps of:

providing a container paperboard blank having four rectangular panels hingedly connected to each other along parallel transverse score lines, each of the four panels having a pair of end flaps hingedly connected to opposing longitudinal edges of each of the panels and the four panels corresponding to a first side wall, a front wall, a second side wall, and a back wall of the container, wherein a longitudinal tear strip extends integrally across the first side wall, the front wall, and the second side wall;

providing a liner paperboard blank having at least three rectangular panels hingedly connected to each other along parallel transverse score lines, the liner blank panels being sized so that the liner fits snugly within the container, and one of the liner blank panels corresponding to a front panel of the liner, wherein the liner front panel includes a flap and a flap-receiving portion disposed in forcibly displaceable mutual engagement;

positioning the liner blank over the container blank with the liner front panel adjacent to and substantially overlapping the container front wall, the flap and the flap-receiving portion being disposed in proximity to the tear strip;

adhering the flap-receiving portion to the container blank;

shaping the liner blank into the liner; and shaping the container blank into the container with the liner disposed therein.

14. The method as recited in claim 13, wherein the step of positioning the liner blank over the container blank further includes adhering the liner blank to the container blank.

15. The method as recited in claim 13, further including the step of removing the tear strip to form the container having a lid and a base section, the base section having the liner disposed therein.

16. The method as recited in claim 15, further including the step of opening the lid by exerting a force which disengages the mutual engagement between the flap and the flap-receiving portion.

17. The method as recited in claim 16, further including the step of reclosing the lid by snap-re-engagement of the flap and the flap-receiving portion.

* * * * *